US011123850B2

(12) United States Patent
Jaskot et al.

(10) Patent No.: US 11,123,850 B2
(45) Date of Patent: Sep. 21, 2021

(54) CORDLESS CONCRETE NAILER WITH REMOVABLE LOWER CONTACT TRIP

(71) Applicant: BLACK & DECKER INC., New Britain, CT (US)

(72) Inventors: Erin Elizabeth Jaskot, Richmond, VA (US); Stuart Garber, Towson, MD (US)

(73) Assignee: Black & Decker Inc., New Britain, CT (US)

( * ) Notice: Subject to any disclaimer, the term of this patent is extended or adjusted under 35 U.S.C. 154(b) by 879 days.

(21) Appl. No.: 15/632,829

(22) Filed: Jun. 26, 2017

(65) Prior Publication Data

US 2018/0001457 A1 Jan. 4, 2018

Related U.S. Application Data

(60) Provisional application No. 62/356,649, filed on Jun. 30, 2016.

(51) Int. Cl.
*B25C 1/06* (2006.01)
*B25C 1/00* (2006.01)

(52) U.S. Cl.
CPC ..... *B25C 1/06* (2013.01); *B25C 1/008* (2013.01)

(58) Field of Classification Search
CPC ..... B25C 1/06; B25C 1/008
USPC ..... 227/119
See application file for complete search history.

(56) References Cited

U.S. PATENT DOCUMENTS 3,853,257 A 12/1974 Perkins
4,405,071 A 9/1983 Austin
5,261,587 A 11/1993 Robinson
5,337,635 A 8/1994 Habermehl
(Continued)

FOREIGN PATENT DOCUMENTS

EP 0747176 B1 5/2001
EP 1642684 A4 9/2008
(Continued)

OTHER PUBLICATIONS

International Search Report and Written Opinion dated Oct. 17, 2017 in corresponding International Patent Application No. PCT/US2017/039971.
(Continued)

*Primary Examiner* — Chelsea E Stinson
*Assistant Examiner* — Mary C Hibbert-Copeland
(74) *Attorney, Agent, or Firm* — Harness, Dickey & Pierce, P.L.C.

(57) ABSTRACT

A removable contact trip can be received in an aperture of the barrel and can be slidable between a retracted position and an extended position relative to an end of the barrel. The removable contact trip can define a muzzle aperture aligned with the driver axis and through which a fastener is driven by the nail driver. The removable contact trip can include a latch pocket. A removable contact trip latch can be biased toward a latched position in which the removable contact trip latch extends through a window of the barrel and is receivable in the latch pocket to latch the removable contact trip to the barrel. The removable contact trip latch can also be movable to an unlatched position in which the removable contact trip latch is not receivable in the latch pocket to unlatch and permit removal of the contact trip from the barrel.

25 Claims, 14 Drawing Sheets

(56) References Cited

U.S. PATENT DOCUMENTS

| | | | |
|---|---|---|---|
| 5,469,767 | A | 11/1995 | Habermehl |
| 5,568,753 | A | 10/1996 | Habermehl et al. |
| 5,649,661 | A | 7/1997 | Masuno et al. |
| 5,699,704 | A | 12/1997 | Habermehl |
| 5,715,982 | A | 2/1998 | Adachi |
| 5,819,609 | A | 10/1998 | Habermehl |
| 5,855,151 | A | 1/1999 | Habermehl |
| 5,870,933 | A | 2/1999 | Habermehl et al. |
| 5,927,163 | A | 7/1999 | Habermehl et al. |
| 5,934,162 | A | 8/1999 | Habermehl |
| 5,943,926 | A | 8/1999 | Habermehl |
| 5,996,875 | A | 12/1999 | Clark et al. |
| 6,055,891 | A | 5/2000 | Habermehl |
| 6,089,132 | A | 7/2000 | Habermehl |
| 6,244,140 | B1 | 6/2001 | Habermehl |
| 6,363,818 | B1 | 4/2002 | Habermehl |
| 6,409,068 | B1 | 6/2002 | Lee |
| 6,425,306 | B1 | 7/2002 | Habermehl |
| 6,439,085 | B1 | 8/2002 | Habermehl et al. |
| 6,449,822 | B1 | 9/2002 | Gilbert et al. |
| 6,453,780 | B2 | 9/2002 | Habermehl |
| 6,557,745 | B2 | 5/2003 | Wang |
| 6,601,480 | B1 | 8/2003 | Habermehl |
| 6,647,836 | B1 | 11/2003 | Habermehl |
| 6,705,501 | B2 | 3/2004 | Miller et al. |
| 6,783,044 | B2 | 8/2004 | Perra et al. |
| 6,808,100 | B2 | 10/2004 | Fielitz et al. |
| 6,851,595 | B1 | 2/2005 | Lee |
| 6,862,963 | B2 | 3/2005 | Habermehl et al. |
| 6,941,847 | B2 | 9/2005 | Habermehl et al. |
| 6,959,630 | B2 | 11/2005 | Habermehl |
| 6,997,365 | B2 | 2/2006 | Miller et al. |
| 7,175,063 | B2 | 2/2007 | Osuga et al. |
| 7,341,146 | B2 | 3/2008 | Habermehl |
| 7,815,086 | B2 | 10/2010 | Kubo |
| 7,922,054 | B2 | 4/2011 | Cole, Jr. |
| 8,146,788 | B2 | 4/2012 | Hlinka et al. |
| 8,152,038 | B2 | 4/2012 | Rouger et al. |
| 8,220,686 | B2 | 7/2012 | Kestner et al. |
| 8,292,143 | B2 | 10/2012 | Lee et al. |
| 8,408,438 | B2 | 4/2013 | Taylor |
| 8,453,902 | B2 | 6/2013 | Jang |
| 2004/0149800 | A1 | 8/2004 | Perra et al. |
| 2004/0245312 | A1* | 12/2004 | Miller ..... B25C 1/008 227/142 |
| 2006/0081677 | A1 | 4/2006 | Yasuike et al. |
| 2006/0157528 | A1 | 7/2006 | Osuga et al. |
| 2008/0223898 | A1 | 9/2008 | Rouger et al. |
| 2009/0020582 | A1 | 1/2009 | Kubo |
| 2009/0020583 | A1 | 1/2009 | Kestner et al. |
| 2010/0072247 | A1 | 3/2010 | Cole, Jr. |
| 2011/0062208 | A1 | 3/2011 | Hlinka et al. |
| 2011/0132958 | A1* | 6/2011 | Hlinka ..... B25C 1/008 227/8 |
| 2012/0085806 | A1* | 4/2012 | Lee ..... B25C 1/008 227/8 |
| 2012/0211541 | A1 | 8/2012 | Taylor |
| 2012/0228354 | A1 | 9/2012 | Schwartzenberger |

FOREIGN PATENT DOCUMENTS

| | | | |
|---|---|---|---|
| EP | 1590130 | B1 | 10/2009 |
| EP | 1980370 | B1 | 11/2010 |
| EP | 2165806 | B1 | 3/2011 |
| GB | 2382047 | B | 11/2003 |
| JP | 2000/061865 | A | 2/2000 |
| JP | 2000/334680 | A | 12/2000 |
| WO | WO-2008/115721 | A1 | 9/2008 |
| WO | WO-2009/012027 | A1 | 1/2009 |
| WO | WO-2012/112663 | A1 | 8/2012 |
| WO | WO-2012/122327 | A1 | 9/2012 |

OTHER PUBLICATIONS

Office Action dated Jan. 29, 2020 in corresponding European Patent Application No. 17737453.5.

* cited by examiner

CORDLESS CONCRETE NAILER WITH REMOVABLE LOWER CONTACT TRIP

CROSS-REFERENCE TO RELATED APPLICATIONS

This application claims the benefit of U.S. Provisional Application No. 62/356,649, filed on Jun. 30, 2016. The entirety of the above application is incorporated herein by reference.

FIELD

The present disclosure relates to a cordless concrete nailer with a removable lower contact trip.

BACKGROUND

This section provides background information related to the present disclosure which is not necessarily prior art.

Fastening tools, such as power nailers have become relatively common place in the construction industry. Pneumatically-powered nailers, which are connected to an air compressor via an air hose, and powder nailers, which employ a powder fuel source that is rapidly combusted to produce a volume of pressurized gas, initially dominated the market. Both products, however, suffer from several drawbacks.

Pneumatically powered nailers require a relatively expensive air compressor that can be relatively cumbersome to transport. Additionally, it can be inconvenient to operate the nailer while it is tethered (via the air hose) to the air compressor. Many of the nailers powered by a powder fuel source are of the "single shot" variety and require significant effort to reload. Additionally, nailers employing a powder fuel source can be relatively noisy and can produce unpleasant odors during their operation.

Despite these limitations, pneumatic and powder-powered nailers continue to predominate for those construction applications, such as steel framing and concrete construction, that employ fasteners requiring a high degree of power to install the fasteners. Hence, while cordless electric nailers have become very successful for use in conventional wood construction (i.e., framing and trimming), cordless electric power nailers of this type are presently not suitable for use in steel framing or concrete construction applications.

A fastener can occasionally become jammed in the nosepiece of a nailer. Such jams can be particularly difficult to clear when the fastener is being driven by the tool at the forces required to reliably install concrete fasteners, including the installation of hardened fasteners through steel framing into concrete. A removable lower contact trip would facilitate clearing any such jams; particularly one that is retained by a latch, making quick, easy, and tool-less removal and reassembly of the removable contact trip possible.

SUMMARY

This section provides a general summary of the disclosure, and is not a comprehensive disclosure of its full scope or all of its features. In addition, any feature or combination of features included in this general summary is not necessarily critical or particularly important to the disclosure.

In accordance with an aspect of the disclosure, a cordless electric nailer can include a battery-powered electric motor driven flywheel selectively engageable against a nail driver to fire the nail driver along a driver axis extending through a barrel of a nosepiece. A removable contact trip can be received in an aperture of the barrel and can be slidable between a retracted position and an extended position relative to an end of the barrel. The removable contact trip can define a muzzle aperture aligned with the driver axis and through which a fastener is driven by the nail driver. The removable contact trip can include a latch pocket. A removable contact trip latch can be coupled to the barrel and can be biased toward a latched position in which the removable contact trip latch extends through a window of the barrel and is receivable in the latch pocket to latch the removable contact trip to the barrel. The removable contact trip latch can also be movable to an unlatched position in which the removable contact trip latch is not receivable in the latch pocket to unlatch the removable contact trip and permit removal of the contact trip from the barrel.

In accordance with another aspect of the disclosure, a cordless electric concrete nailer can include a battery-powered electric motor driven flywheel selectively engageable against a concrete nail driver to fire the concrete nail driver along a driver axis extending through a barrel of a nosepiece. A removable contact trip can be received in an aperture of the barrel and can be slidable between a retracted position and an extended position relative to an end of the barrel. The removable contact trip can define a muzzle aperture aligned with the driver axis and through which a fastener is driven by the concrete nail driver. The removable contact trip can include a latch pocket. A removable contact trip latch can be pivotably coupled to the barrel. A biasing member can bias the removable contact trip latch toward a latched position in which the removable contact trip latch extends through a window of the barrel and is receivable in the latch pocket to latch the removable contact trip to the barrel. A lever can extend from the removable contact trip latch that can be manually engaged to pivot the removable contact trip latch against the biasing member and pull the removable contact trip latch from the latched position into an unlatched position, in which the removable contact trip latch is not receivable in the latch pocket to unlatch the removable contact trip and permit removal of the contact trip from the barrel.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
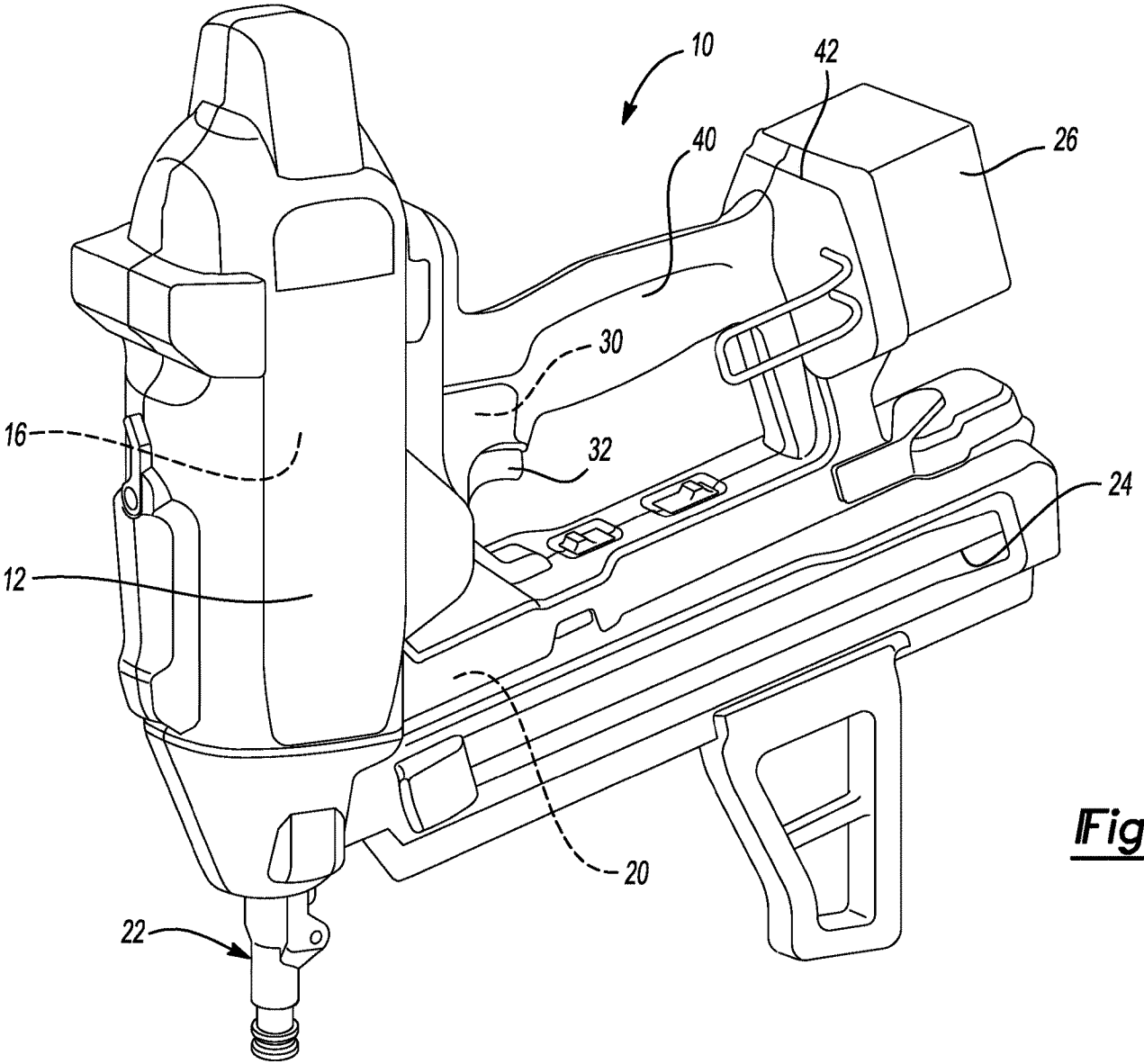
FIG. 1 is a perspective view of an exemplary nailer constructed in accordance with the teachings of the present disclosure.
Figure 2:
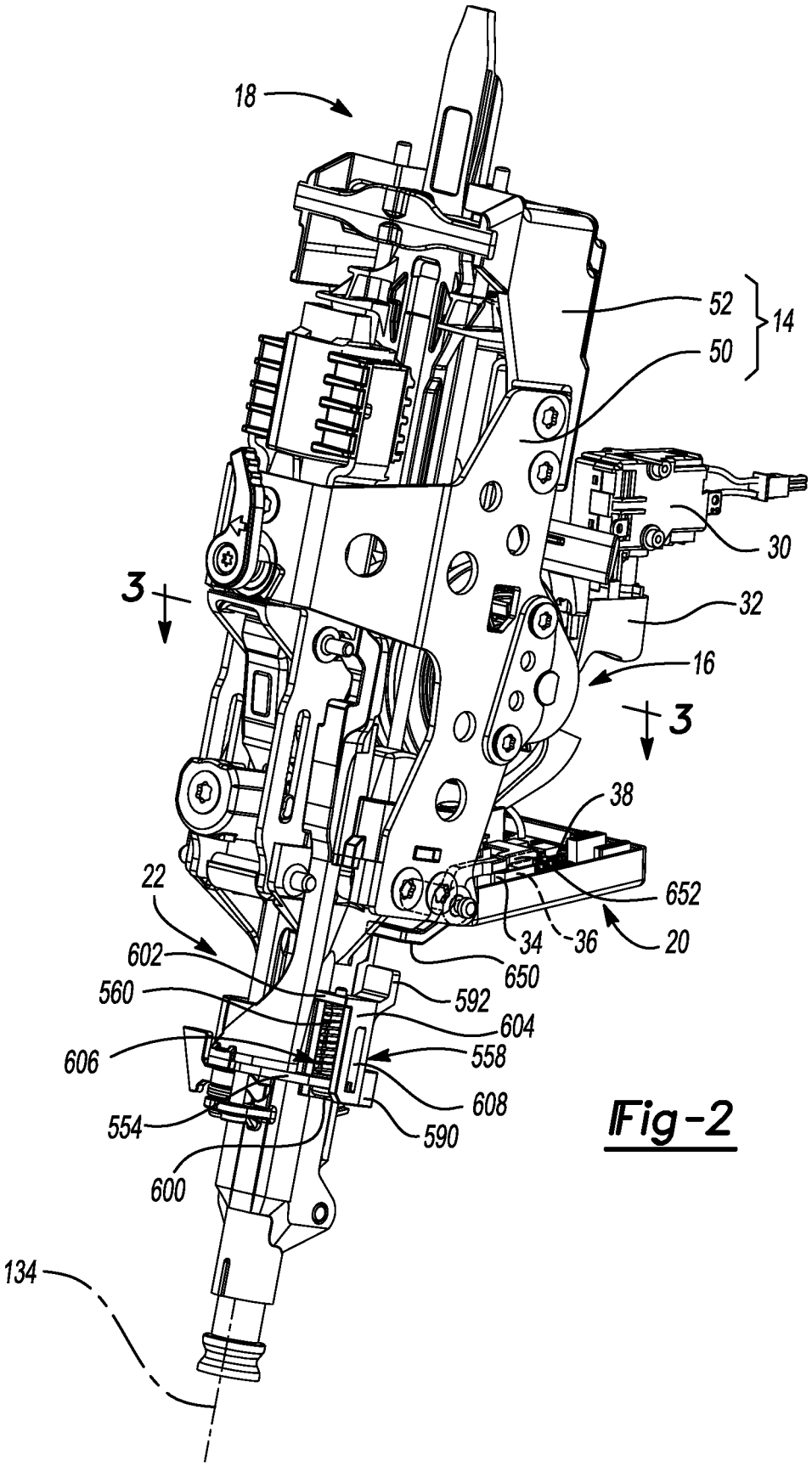
FIG. 2 is a perspective view of a portion of the nailer of FIG. 1.

With reference to FIGS. 1 and 2 of the drawings, a cordless nailer constructed in accordance with the teachings of the present disclosure is generally indicated by reference numeral 10. The driving tool 10 can include a housing 12, a frame 14, a drive motor assembly 16, a return mechanism 18, a control unit 20, a nosepiece assembly 22, a magazine assembly 24 and a battery pack 26. The nosepiece assembly 22, the magazine assembly 24 and the battery pack 26 can be constructed in a conventional manner and as such, need not be described in detail herein. The control unit 20 can include various switches, such as a trigger switch 30, which is responsive to a state of a trigger 32, and a contact trip switch 34, which is responsive to a state of a contact trip 36 associated with the nosepiece assembly 22, various sensors, such as a motor speed sensor (not shown), and a controller 38 that can receive signals from the various switches and sensors and responsively operate the drive motor assembly 16 and the return mechanism 18.

The housing 12 can be of a clam-shell construction that can be employed to cover various components of the nailer 10, such as the drive motor assembly 16, the return mechanism 18 and the control unit 20. The housing 12 can form a handle 40 that can be grasped by the operator of the nailer 10 to operate the nailer 10, and a battery pack mount 42 to which the battery pack 26 can be fixedly but removably coupled.

The frame 14 can formed of one or more frame components and is the structure to which the drive motor assembly 16, the return mechanism 18 and the nosepiece assembly 22 can be fixedly coupled. In the particular example provided, the frame 14 comprises a motor mount 50 and a return mechanism mount 52 that are fixedly coupled to one another via a plurality of threaded fasteners (not specifically shown).

Figure 3:
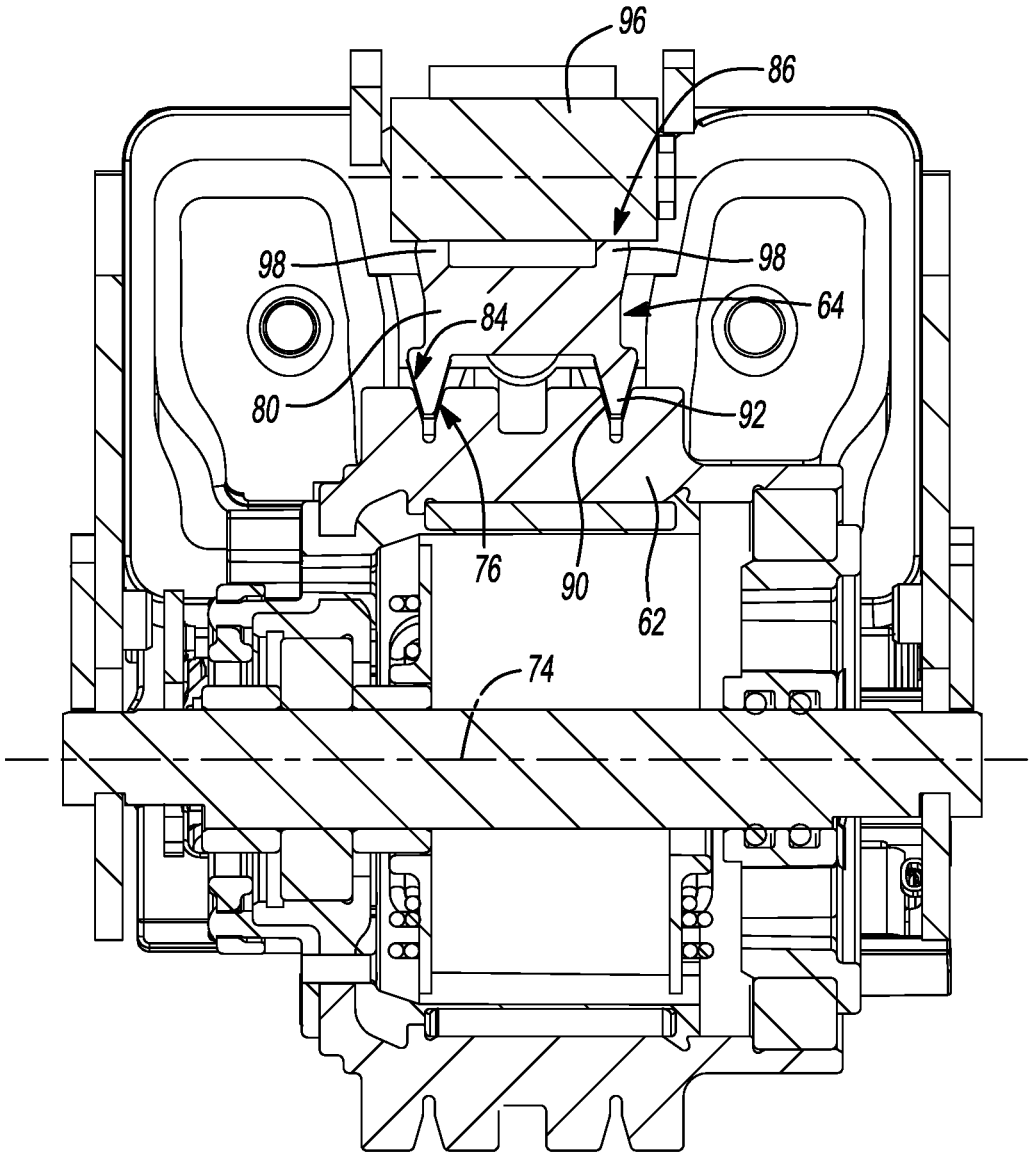
FIG. 3 is a section view taken through a portion of the nailer of FIG. 1, depicting a flywheel, a driver and a pinch roller in more detail.
Figure 4:
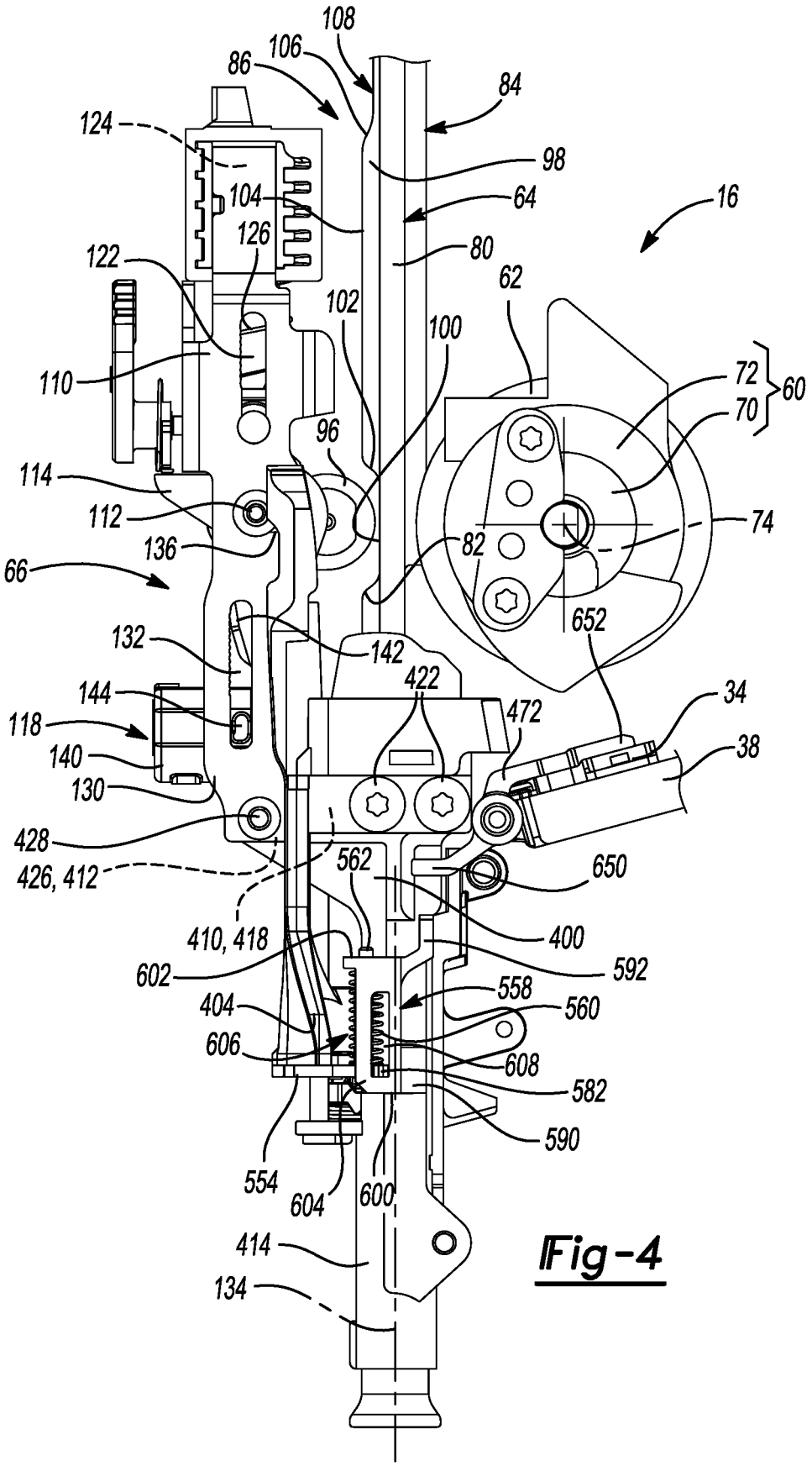
FIG. 4 is a side elevation view of a portion of the nailer of FIG. 1.

With reference to FIGS. 3 and 4, the drive motor assembly 16 can comprise an electric motor 60, a flywheel 62, a driver 64 and a power take-off unit (PTU) 66. The electric motor 60 can be an inside-out motor having a stator 70, which is fixedly coupled to the motor mount 50 (FIG. 2), and a rotor 72 that can be disposed about (i.e., radially outwardly of) the stator 70. The flywheel 62 can be disposed about (i.e., radially outwardly of) and fixedly coupled to the rotor 72 such that the rotor 72 and the flywheel 62 are rotatable about a common rotational axis 74. As best shown in FIG. 3, the flywheel 62 can have a flywheel profile 76 on its outer circumferential surface.

Figure 5:
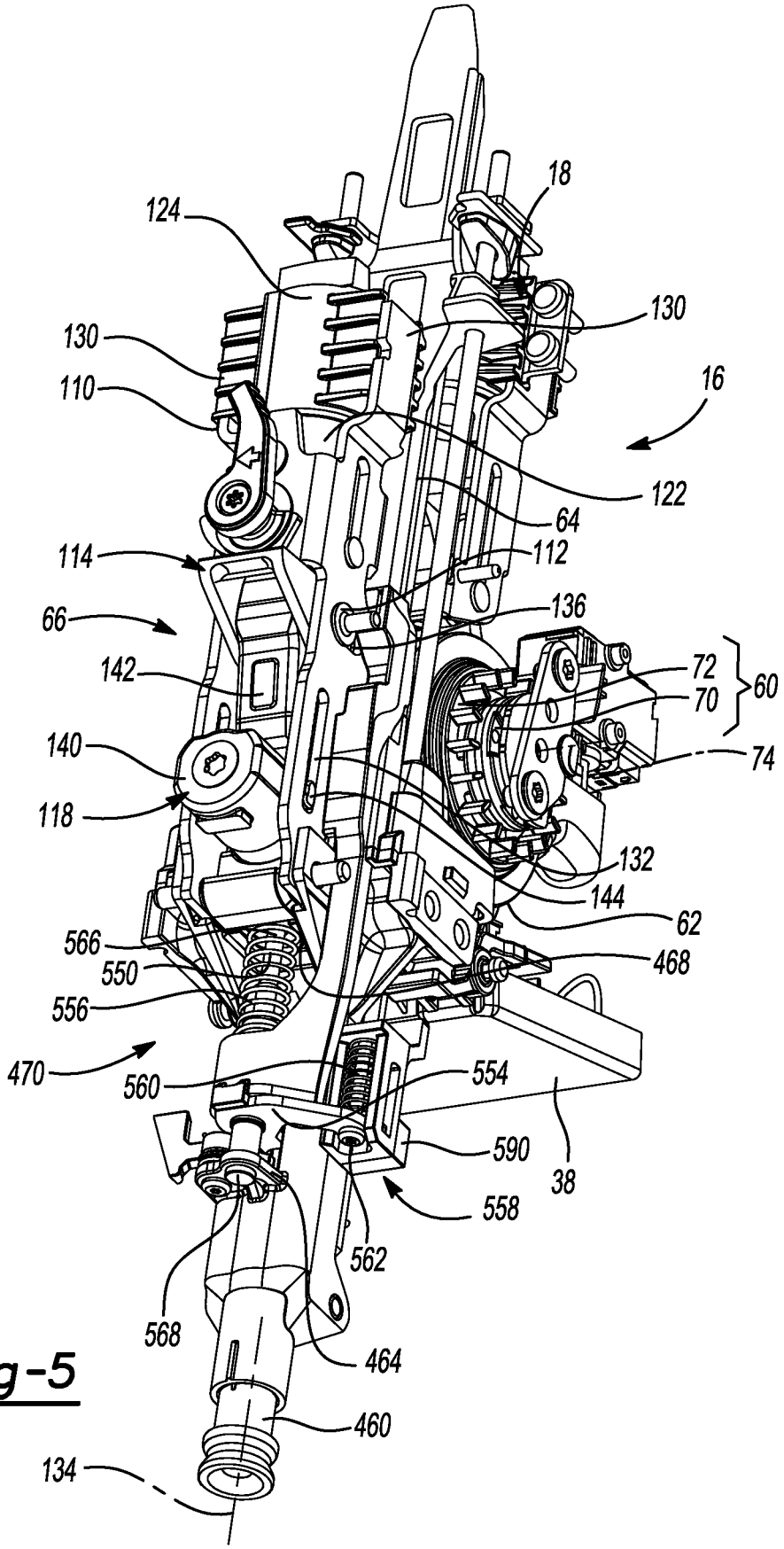
FIG. 5 is a perspective view of a portion of the nailer of FIG. 1, illustrating a drive motor assembly in more detail.

With reference to FIGS. 3 through 5, the driver 64 can include a driver body 80 and a driver blade 82. The driver body 80 can have a driver profile 84 on a first surface, and a cam profile 86 on a second surface that is opposite the first surface. The driver profile 84 is configured to meshingly engage the flywheel profile 76 on the flywheel 62. The flywheel profile 76 and driver profile 84 can cooperate to provide increased surface area over which the flywheel 62 and the driver 64 contact one another (relative to a configuration that employs a cylindrically-shaped surface on the flywheel 62 and a flat surface on the driver 64) and/or can provide a configuration that maintains a desired level of contact between the flywheel 62 and the driver 64 despite the occurrence of wear on one or both of the flywheel 62 and the driver 64. In the example provided, resistance to wear is created through the use of V-shaped grooves 90 in the flywheel profile 76 and mating V-shaped ribs 92 on the driver profile 84. The driver blade 82 can be integrally and unitarily formed with the driver body 80 from an appropriate material, such as ISI 6150 steel. The cam profile 86 is configured to be contacted by a pinch roller 96 of the PTU 66. The cam profile 86 cooperates with the PTU 66 to coordinate the generation of a clamping force that is transmitted between the driver profile 84 and the flywheel profile 76. In the example provided, the cam profile 86 includes a pair of contoured rails 98, each of which having a first rest portion 100, a loading ramp 102, a sustained load portion 104, an unloading ramp 106 and a second rest portion 108. The first and second rest portions 100 and 108 are generally flat and are sized so that no or relatively little clamp load is generated when the pinch roller 96 is disposed on either of those portions. The sustained load portion 104 is configured to cooperate with the PTU 66 to generate a clamping force that is within a predetermined load range. The loading ramp 102 tapers from the first rest portion 100 to the sustained load portion 104, while the unloading ramp 106 tapers from the sustained load portion 104 to the second rest portion 108.

Figure 6:
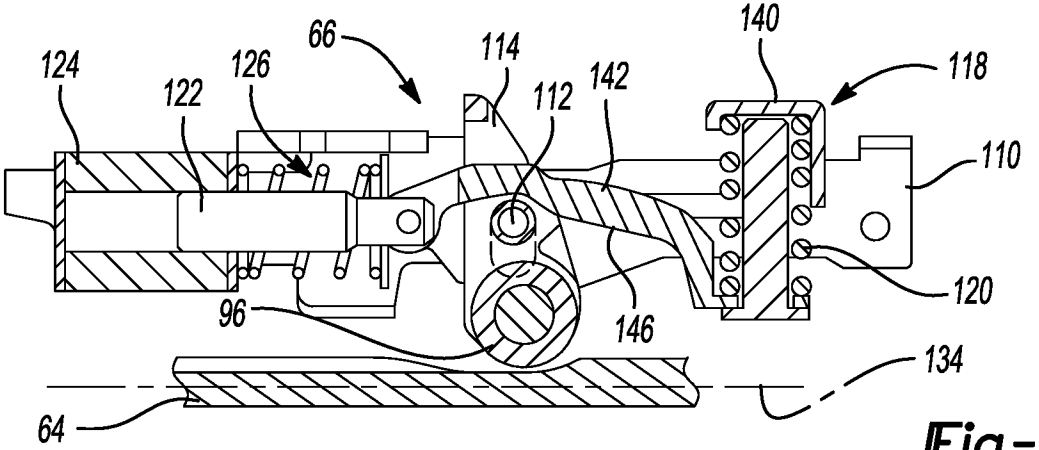
FIG. 6 is a longitudinal section view of a portion of the nailer of FIG. 1, illustrating the drive motor assembly in more detail.

With reference to FIGS. 4 through 6, the PTU 66 can include an activation arm 110, a yoke axle 112, a pinch roller yoke 114, the pinch roller 96, a spring mount 118, a spring 120, a plunger 122, a PTU solenoid 124 and a solenoid spring 126. The activation arm 110 can be fixedly coupled to the motor mount 50 (FIG. 2) and can include a pair of arm members 130, each of which defining a spring slot 132, which can be disposed generally parallel to a driver axis 134 along which the driver 64 can translate, and an axle slot 136 that can be disposed generally perpendicular to the driver axis 134. The yoke axle 112 can be received into the axle slots 136 in the arm members 130 so that the yoke axle 112 can rotate about its axis within the axle slots 136 and can move generally perpendicular to the driver axis 134 relative to the activation arm 110. The pinch roller yoke 114 can be pivotably mounted on the yoke axle 112. The pinch roller 96 can be rotatably mounted to the pinch roller yoke 114 at a location that is offset from the yoke axle 112. The spring mount 118 can include a spring seat 140 and a spring arm 142. The spring 120 can be received in the spring mount 118 such that a first end of the spring 120 abuts the spring seat 140 and a second, opposite end of the spring 120 abuts an end of the spring arm 142. The spring mount 118 can include a pair of tabs 144, each of which being received in a corresponding one of the spring slots 132. The spring arm 142 defines an axle cam 146 that contacts the yoke axle 112. The plunger 122 is coupled to an end of the spring arm 142 that is opposite the spring 120 and the spring mount 118. The solenoid spring 126 is configured to bias the plunger 122 away from the PTU solenoid 124 and toward the spring seat 140. The PTU solenoid 124 is configured to selectively generate a magnetic field that draws the plunger 122 in a direction that is parallel to the driver axis 134 into the PTU solenoid 124 against the bias of the solenoid spring 126. Movement of the plunger 122 toward the PTU solenoid 124 causes corresponding motion of the spring arm 142, and therefore corresponding translation of the axle cam 146 across the yoke axle 112, which causes the axle cam 146 to drive the yoke axle 112 (and therefore the pinch roller yoke 114 and the pinch roller 96) in a direction generally perpendicular to the driver axis 134 and toward the flywheel 62.

Operation of the PTU solenoid 124 when the flywheel 62 is rotated within a predetermined speed range will cause the plunger 122 to move the spring mount 118 toward the PTU solenoid 124 so that the axle cam 146 drives the yoke axle 112, and therefore the pinch roller 96, toward the flywheel 62. Initial contact between the pinch roller 96 and the first rest portion 100 of the cam profile 86 drives the driver profile 84 into contact with the (rotating) flywheel profile 76 so that the rotational energy of the flywheel 62 begins to drive the driver 64 along the driver axis 134 from a driver returned position to driver extended position. Movement of the driver 64 along the driver axis 134 toward the driver extended position causes the pinch roller 96 to ride up the loading ramp 102 and onto the sustained load portion 104, which drives the yoke axle 112 away from the flywheel 62. Movement of the yoke axle 112 away from the flywheel 62 correspondingly moves the spring arm 142 so that the spring 120 is compressed between the spring seat 140 and the end of the spring arm 142. A corresponding reaction force is applied through the yoke axle 112, the pinch roller yoke 114, and the pinch roller 96 to the driver 64 to provide the clamping force that drives the driver profile 84 into the flywheel profile 76 so that the rotational energy of the flywheel 62 can be rapidly transmitted to the driver 64 to rapidly accelerate the driver 64 along the driver axis 134. Compression of the spring 120 is released as the unloading ramp 106 travels over pinch roller 96. Additionally, the pinch roller yoke 114 pivots about the yoke axle 112 so that the pinch roller 96 pivots toward the PTU solenoid 124 when the pinch roller 96 is disposed over the second rest portion 108. Thereafter, the return mechanism 18 can be selectively operated by the controller 38 to return the driver 64 from the driver extended position to the driver returned position.

Figure 7:
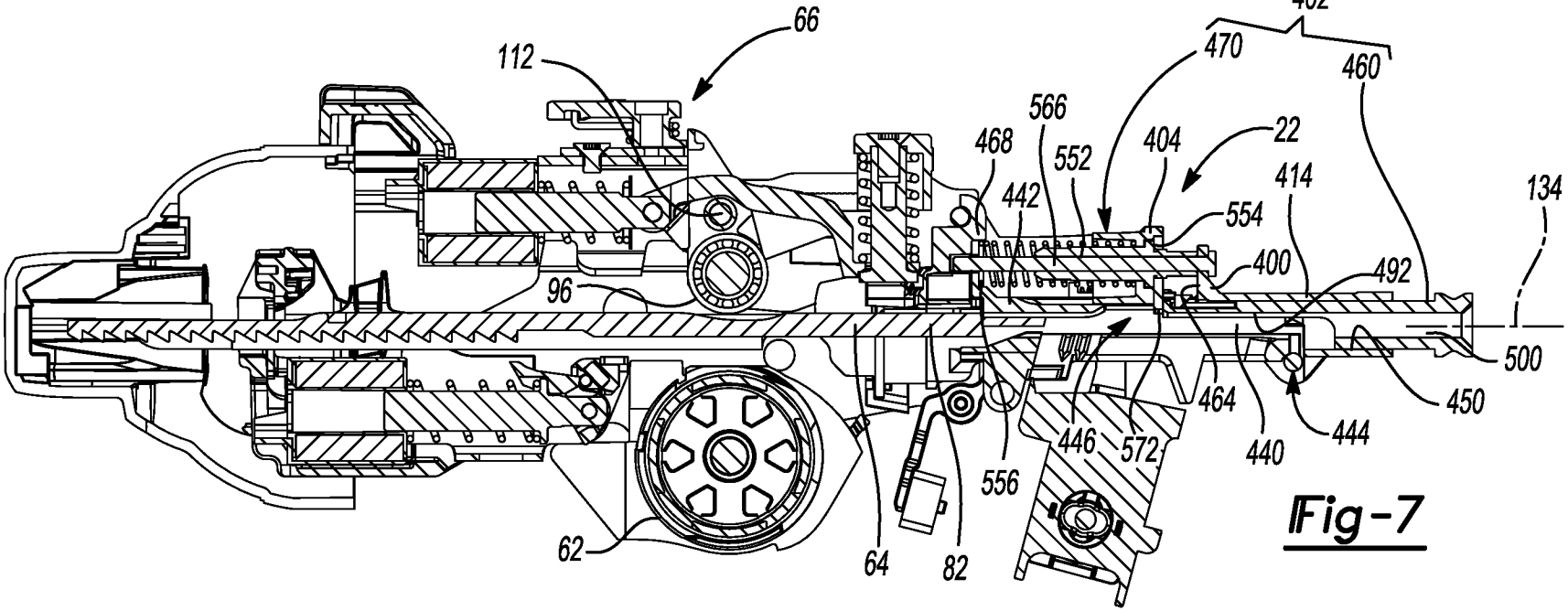
FIG. 7 is a longitudinal section view of the nailer of FIG. 1.
Figure 8:
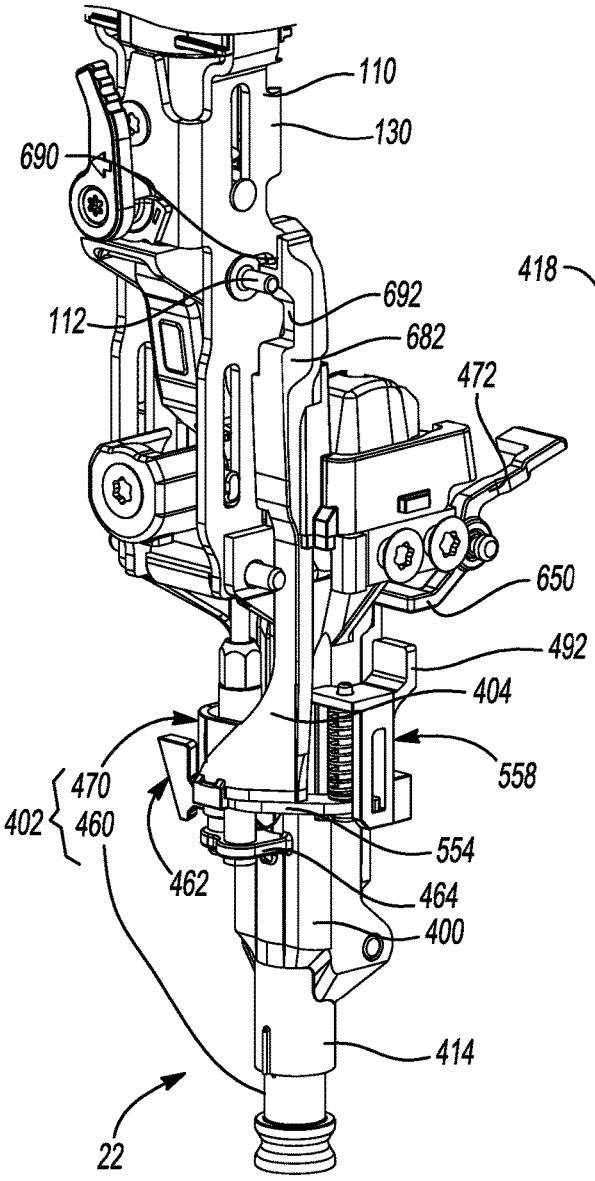
FIG. 8 is a perspective view of a portion of the nailer of FIG. 1 illustrating a nosepiece assembly and a portion of a drive motor assembly in more detail.

With reference to FIGS. 7 and 8, the nosepiece assembly 22 can include a nosepiece 400, a contact trip mechanism 402 and a spring shroud 404. The nosepiece 400 can include a frame mount 410, an activation arm mount 412, and a barrel 414.

Figure 11:
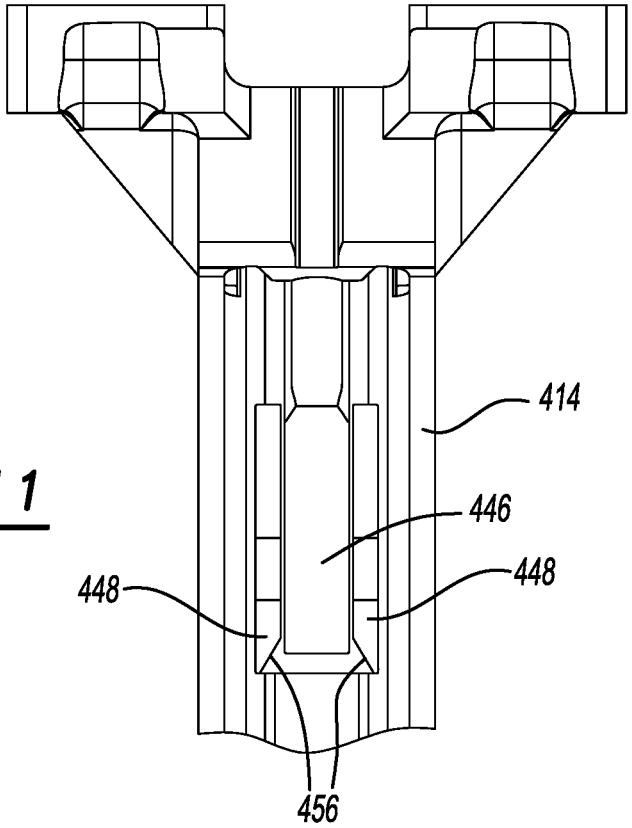
FIG. 11 is a side elevation view of a portion of the barrel.

The frame mount 410 can be configured to be fixedly coupled to the motor mount 50 (FIG. 4) and in the particular example provided, include a pair of mounting bosses 418 that are disposed on opposite lateral sides of the barrel 414. Each of the mounting bosses 418 can have a pair of threaded holes (not specifically shown) that receive threaded fasteners 422 (FIG. 4) therein that fixedly but removably couple an associated side of the motor mount 50 (FIG. 4) thereto. The activation arm mount 412 can include a pair of arm mounts 426 that are disposed on opposite lateral sides of the barrel 414. Each of the arm mounts 426 is configured to receive an end of an associated one of the arm members 130 (FIG. 4) therein. A pin 428 can be employed to secure the arm members 130 (FIG. 4) to the arm mounts 426. The barrel 414 can be fixedly coupled to (e.g., unitarily and integrally formed with) the frame mount 410 and the activation arm mount 412 and can extend therefrom along the driver axis 134. The barrel 414 can define a barrel aperture 440, one or more driver guides 442, a magazine mount 444, a contact trip window 446, a pair of muzzle guide rails 448, and a muzzle bore 450. The barrel aperture 440 can be sized and shaped to receive the driver 64 therein. The driver guides 442 can extend into the barrel aperture 440 and can be configured to guide the driver blade 82 as the driver 64 moves along the driver axis 134. The magazine mount 444 is configured to engage an end of the magazine assembly 24 (FIG. 1) so that fasteners stored by the magazine assembly 24 (FIG. 1) can be sequentially dispensed through the barrel 414 and into the barrel aperture 440. The contact trip window 446 can be formed through the barrel 414 at a location that is opposite the magazine mount 444. The muzzle guide rails 448 can be disposed on opposite lateral sides of the contact trip window 446 and can include tapered end surfaces 456 (FIG. 11) that can be disposed proximate the muzzle bore 450.

Figure 9:
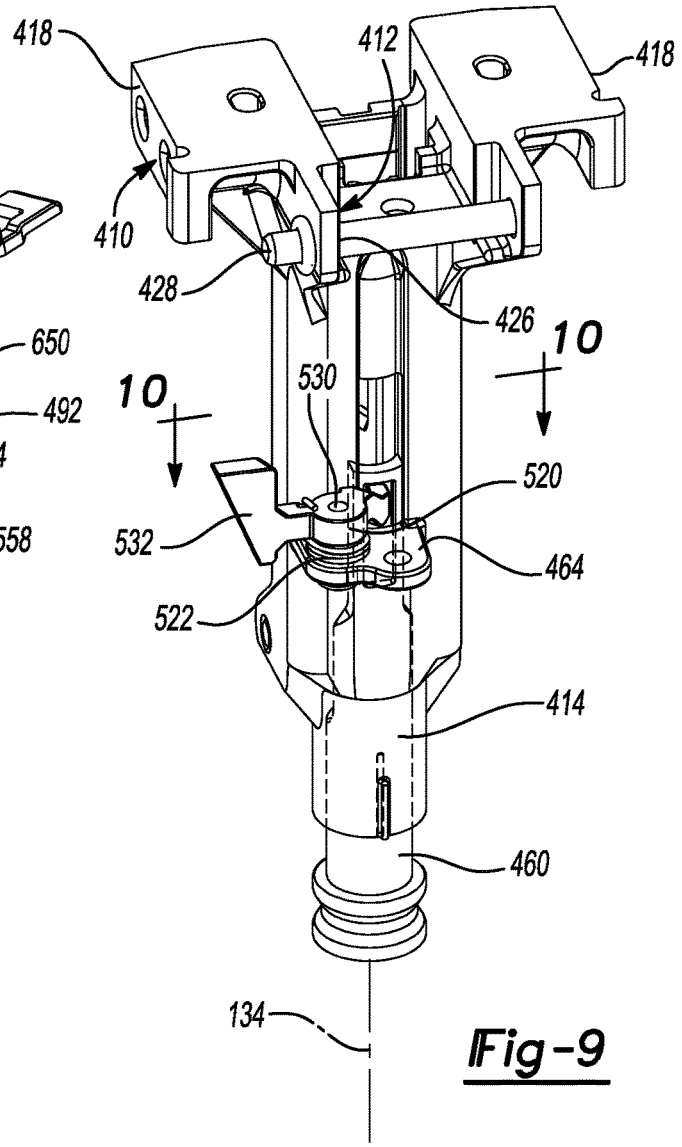
FIG. 9 is a perspective view of a portion of the nosepiece assembly depicted in FIG. 8.

In FIGS. 8 and 9, the contact trip mechanism 402 can include a removable lower contact trip 460, a contact trip latch 462, and an upper contact trip assembly 470. The upper contact trip assembly 470 can include a lower contact trip mount 464 and an upper contact trip mount 468 (FIG. 7) supporting a yoke member 554 that further supports an actuator 558 that is engageable with a switch arm 472.

Figure 12:
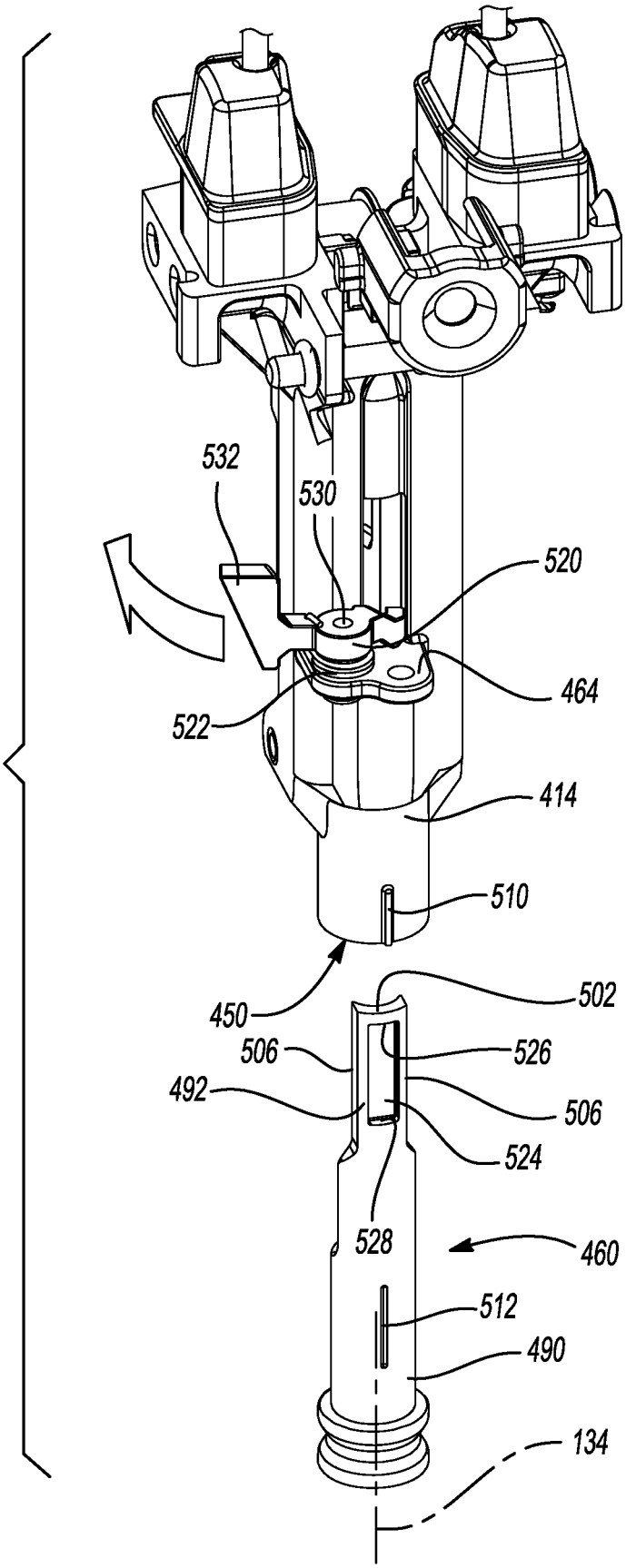
FIG. 12 is an exploded perspective view depicting the removable lower contact trip exploded from the barrel.

In FIG. 12, the removable lower contact trip 460 can be slidably received into the muzzle bore 450 in the barrel 414 and can comprise a tubular muzzle 490 and a muzzle projection 492. The muzzle 490 can define a muzzle aperture 500 (FIG. 7) that is sized to receive one of the fasteners therethrough. The muzzle projection 492 can be fixedly coupled to the muzzle 490 and can define a muzzle guide 502. The muzzle guide 502 can be configured to guide the driver blade 82 (FIG. 7) and/or an associated one of the fasteners as the driver 64 (FIG. 7) and fastener is translated along the driver axis 134. The opposite lateral sides 506 of the muzzle projection 492 can contact the muzzle guide rails 448 (FIG. 11) in the barrel 414 to inhibit rotation of the removable lower contact trip 460 relative to the barrel 414 when the removable lower contact trip 460 is translated or slid relative to the barrel 414 along the driver axis 134. As will be appreciated, contact between one of the lateral sides of the muzzle projection 492 and an associated one of the tapered end surfaces 456 (FIG. 11) can aid in rotationally and/or laterally aligning the muzzle projection 492 to the barrel 414. Optionally, indicia can be employed on the barrel 414 and the muzzle 490 to indicate the desired orientation of the removable lower contact trip 460 to the barrel 414 when the removable lower contact trip 460 is received in the muzzle bore 450. In the example provided, the cooperating indicia includes a first mark 510 that is formed in or on the barrel 414, and a second mark 512 that is formed in or on the removable lower contact trip 460. In the particular example provided, the first and second marks 510 and 512 comprise linear projections that are formed on the barrel 414 and the lower contact trip 460, respectively, that can be recessed, raised or flush relative to surrounding surfaces of the barrel 414 and the removable lower contact trip 460, respectively. The second mark 512 can be oriented in alignment with the first mark 510 (i.e., the removable lower contact trip 460 can be spun about the muzzle bore 450) as the lower contact trip 460 is inserted to the muzzle bore 450 to position the second mark 512 in-line with the first mark 510 to align the removable lower contact trip 460 to the barrel 414 in a desired manner. Additionally or alternatively, the muzzle bore 450 and the removable lower contact trip 460 could be configured so that the removable lower contact trip 460 can be received into the muzzle bore 450 in only one orientation.

Figure 10:
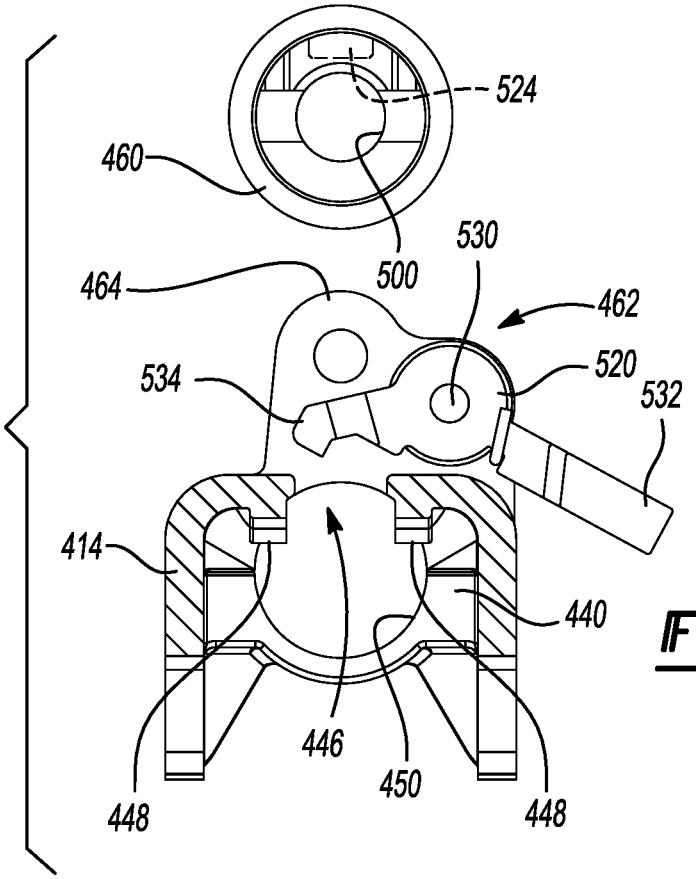
FIG. 10 is a section view taken along the line 10-10 of FIG. 9, with a removable lower contact trip illustrated as being removed from a barrel.

With reference to FIGS. 9 and 10, the contact trip latch 462 can be employed to both remove and secure the removable lower contact trip 460 to the barrel 414 in a tool-less manner. In the example provided, the contact trip latch 462 comprises a latch 520, a torsion spring 522 that biases the latch 520 in a predetermined rotational direction and a latch pocket 524.

With reference to FIGS. 9, 10 and 12, the latch 520 can be pivotably coupled to the barrel 414 via a pivot pin 530 and can include a lever 532 and a latch member 534 that can be disposed on opposite sides of the pivot pin 530. The latch 520 can pivot about the pivot pin 530 such that the latch member 534 can be pivoted through the contact trip window 446 in the barrel 414 and into the barrel aperture 440. In the example provided, the pivot pin 530 is fixedly coupled to the removable lower contact trip mount 464 at an upper portion of the barrel 414, but it will be appreciated that the pivot pin 530 could be fixedly coupled to a lower or tubular end of the barrel 414 in the alternative. The torsion spring 522 can bias the latch 520 about the pivot pin 530 such that the latch member 534 is normally maintained in the barrel aperture 440. The lever 532 can provide a grasping portion to facilitate rotating the latch 532 against the biasing force of the spring 522, which pulls the latch 534 out of the latch pocket 524. The latch pocket 524 can be formed in the muzzle projection 492 and can be sized and shaped to be engaged by the latch member 534. In the example provided, the latch pocket 524 is elongated in a longitudinal direction that is generally parallel to the driver axis 134 to permit the removable lower contact trip 460 to be moved along the driver axis 134 relative to the barrel 414 while the latch 520 is received in the latch pocket 524.

Figure 13:
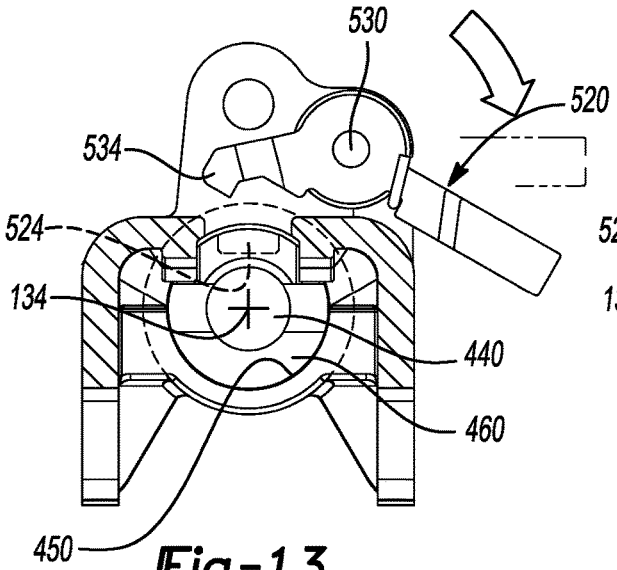
FIG. 13 is a view that is similar to FIG. 10, but illustrating the removable lower contact trip received in the barrel and with the lower contact trip latch disengaged or in an unlatched position permitting removal of the lower contact trip from the barrel.
Figure 14:
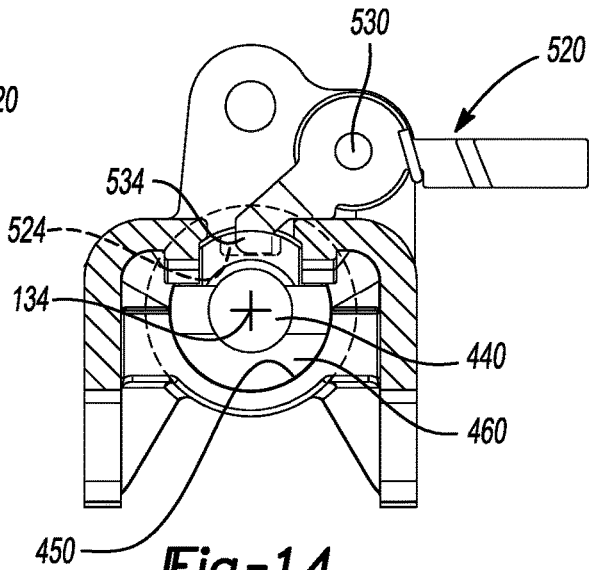
FIG. 14 is a view similar to that of FIG. 13, but illustrating the removable lower contact trip latch engaged in a latched position to retain the lower contact trip within the barrel.

With reference to FIGS. 10, 13 and 14, the latch 520 can be pivoted about the pivot pin 530, using the lever 532 as a grasping portion, between a first latch position (FIG. 14), in which the latch member 534 is disposed in the barrel aperture 440 and the latch pocket 524, and a second latch position (FIG. 13) in which the latch member 534 is retracted from the latch pocket 524. When the removable lower contact trip 460 is received in the muzzle bore 450 and the latch member 534 is disposed in the first latch member position, it will be appreciated that the removable lower contact trip 460 can be translated along the driver axis 134 to a limited extent (i.e., until the latch member 534 abuts a front axial end wall 526 of the latch pocket 524 in the extended position relative to an end of the barrel 414 (e.g., FIG. 5) or a rear axial end wall 528 of the latch pocket 524 in the retracted position relative to an end of the barrel 414 (e.g., FIG. 16) but cannot be withdrawn from the barrel 414. When the removable contact trip latch is latched and the removable contact trip 460 is in the extended position, the contact trip spring 556 can bias the front axial end wall or removal stop surface 526 toward and against the removable contact trip latch 534. Conversely, when the latch member 534 is disposed in the second latch member position, the removable lower contact trip 460 can be withdrawn from the muzzle bore 450.

With reference to FIGS. 7 and 9, the removable lower contact trip mount 464 and the upper contact trip mount 468 can be fixedly coupled to the barrel 414 at locations that conveniently support components of the upper contact trip assembly 470. For example, the lower contact trip mount 464 is a projection that is unitarily and integrally formed with the barrel 414 and disposed at a location on the barrel 414 forwardly of the contact trip window 446. The upper contact trip mount 468 can also be unitarily and integrally formed with the barrel 414 and can span between the frame mount 410 and the activation arm mount 412.

With reference to FIGS. 5 and 7, the upper contact trip assembly 470 can include a slide pin 550, a plunger 552 (FIG. 7), a yoke member 554, a contact trip spring 556, an actuator 558, an actuator spring 560, and an actuator spring follower 562. The slide pin 550 can include a pin member 566, which can be received through corresponding apertures in the lower and upper contact trip mounts 464 and 468, and a head member 568 that can be abutted against the lower contact trip mount 464. The plunger 552 (FIG. 7) can be slidably received on the pin member 566 for sliding movement between the lower and upper contact trip mounts 464 and 468.

Figure 15:
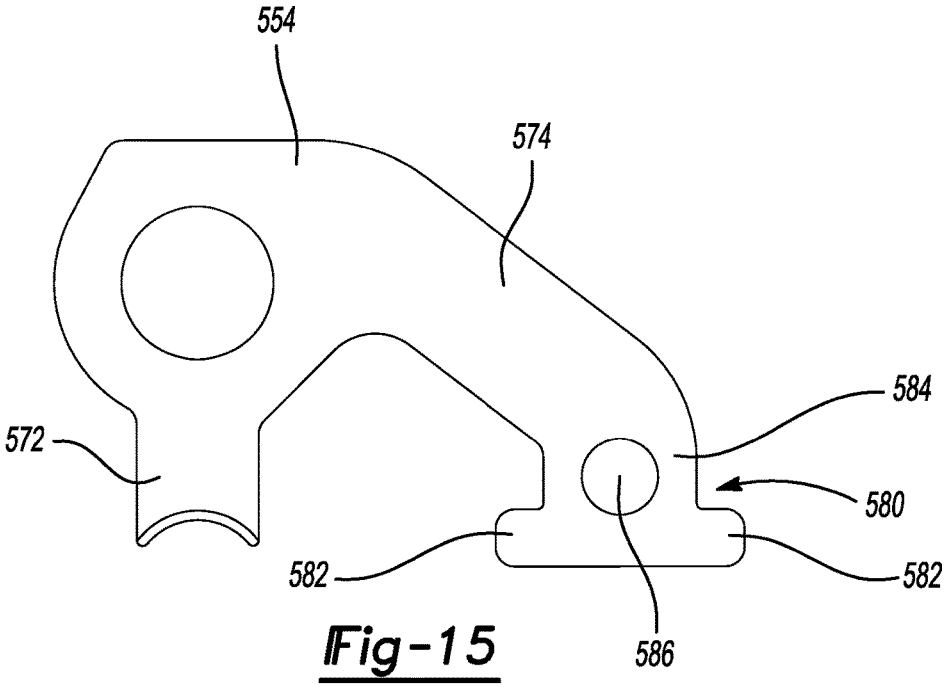
FIG. 15 is a plan view of an actuator foot of the contract trip mechanism.

With reference to FIGS. 5, 7 and 15, the yoke member 554 can be fixedly coupled to the plunger 552 (FIG. 7) and can include a contact trip lever 572 and an actuator arm member 574. The contact trip lever 572 can extend through the contact trip window 446 and can be disposed in-line with the muzzle projection 492 such that an axial end of the muzzle projection 492 can abut or contact the contact trip lever 572. It will be appreciated that movement of the removable lower contact trip 460 along the driver axis 134 in a direction toward the PTU 66 can cause the axial end of the muzzle projection 492 to abut the contact trip lever 572 and then to apply a force to the contact trip lever 572 that causes the yoke member 554 to translate along the slide pin 550 in a direction toward the upper contact trip mount 468. The actuator arm member 574 can terminate at its distal end in an inverted T-shaped foot 580 having a pair of tab members 582 that extend from opposite lateral sides of a stem 584. A first spring follower aperture 586 can be formed through the stem 584.

The contact trip spring 556 can be received on the pin member 566 of the slide pin 550 and the plunger 552. A first end of the contact trip spring 556 can be disposed against the upper contact trip mount 468, while a second, opposite end of the contact trip spring 556 can be abutted against the yoke member 554. If desired, a spring recess (not specifically shown) can be formed in the upper contact trip mount 468 and can be sized to receive the contact trip spring 556 therein. In the example provided, the spring recess is generally U-shaped, with the open end of the U-shape intersecting an edge of the upper contact trip mount 468.

With reference to FIGS. 2 and 4, the actuator 558 can be unitarily formed of a suitable material, such as a plastic material, and can have an actuator body 590 and an actuator arm 592. The actuator body 590 can have a first wall 600, a second wall 602, a pair of third walls 604, a yoke stem slot 606 and a pair of tab member slots 608. The first wall 600 can be offset from the second wall 602 along an axis that can be generally parallel to the driver axis 134. The third walls 604 can be coupled to the first and second walls 600 and 602 on opposite lateral sides of the yoke stem slot 606. Each of the tab member slots 608 can be formed in an associated one of the third walls 604 and can intersect the yoke stem slot 606. The actuator arm 592 can be fixedly coupled to the actuator body 590 and can extend from the second wall 602 in a direction opposite the first wall 600.

With additional reference to FIG. 15, the inverted T-shaped foot 580 of the actuator arm member 574 can be received into the actuator body 590 such that the stem 584 is disposed in the yoke stem slot 606 and each of the tab members 582 is received in an associated one of the tab member slots 608. The actuator spring 560 can be disposed between the second wall 602 and the stem 584 and can bias the actuator 558 relative to the yoke member 554 such that the actuator foot 580 is spaced apart from the yoke member 554 by a first distance along an axis that is generally parallel to the driver axis 134. It will be appreciated, however, that the actuator spring 560 permits the yoke member 554 to be moved relative to the actuator 558 such that the actuator foot 580 is spaced from the yoke member 554 by a second distance (along the axis that is generally parallel to the driver axis 134) that is smaller than the first distance. The actuator spring follower 562 can be fixedly coupled to the actuator arm member 574 and can be received through a hole formed in the second wall 602 of the actuator body 590. The actuator spring 560 can be disposed about the actuator spring follower 562.

The switch arm 472 can be pivotably mounted to the controller 38 and/or motor mount 50 (FIG. 2) and can include a first extending arm member 650, which is configured to be contacted by the extending actuator arm 592, and a second extending arm member 652 that can be configured to contact the contact trip switch 34.

The contact trip spring 556 can bias the plunger 552 and the yoke member 554 along the slide pin 550 in a direction away from the PTU 66. Accordingly, the contact trip lever 572 on the yoke member 554 can abut an axial end of the muzzle projection 492 so the contact trip spring 556 can urge or bias the removable lower contact trip 460 outwardly from the muzzle bore 450 along the driver axis 134 into an extended position relative to an end of the barrel 414. In this condition, the actuator arm 592 is spaced from the switch arm 472 by a sufficient distance so that a spring (i.e., a separate torsion spring and/or a spring associated with the contact trip switch 34) can bias the second arm member 652 away from the contact trip switch 34 by a distance that is sufficient to permit the contact trip to operate in a first state.

Figure 16:
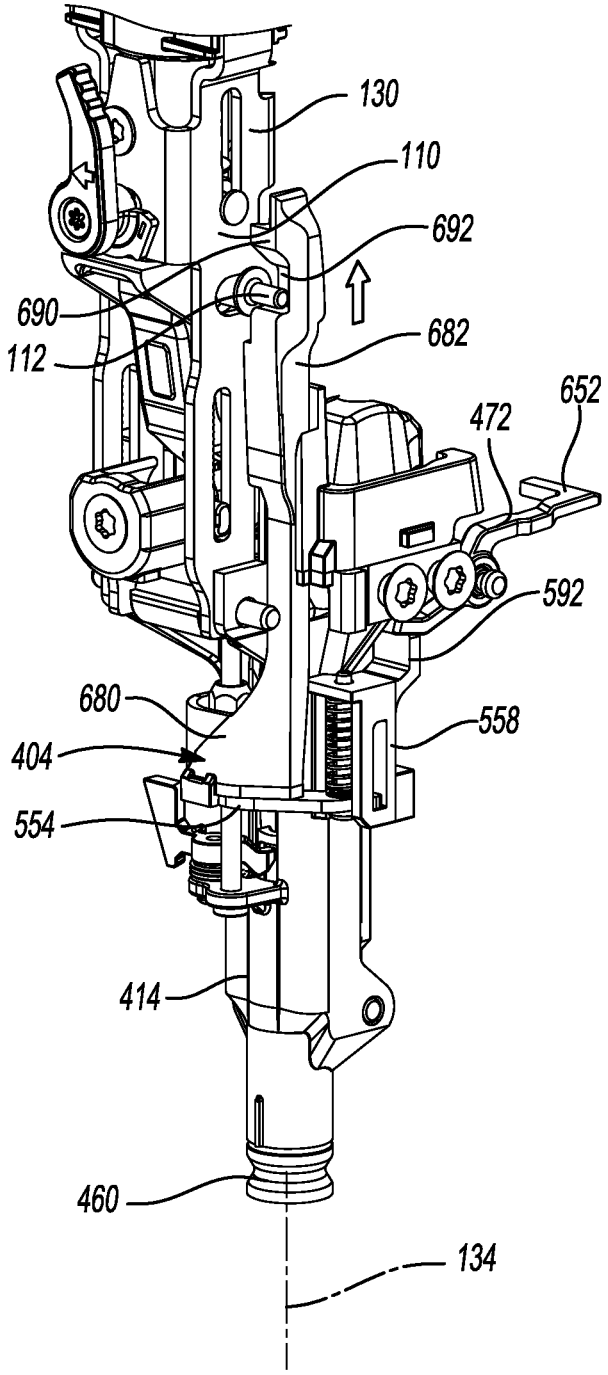
FIG. 16 is a perspective view of various components or portions thereof.
Figure 19:
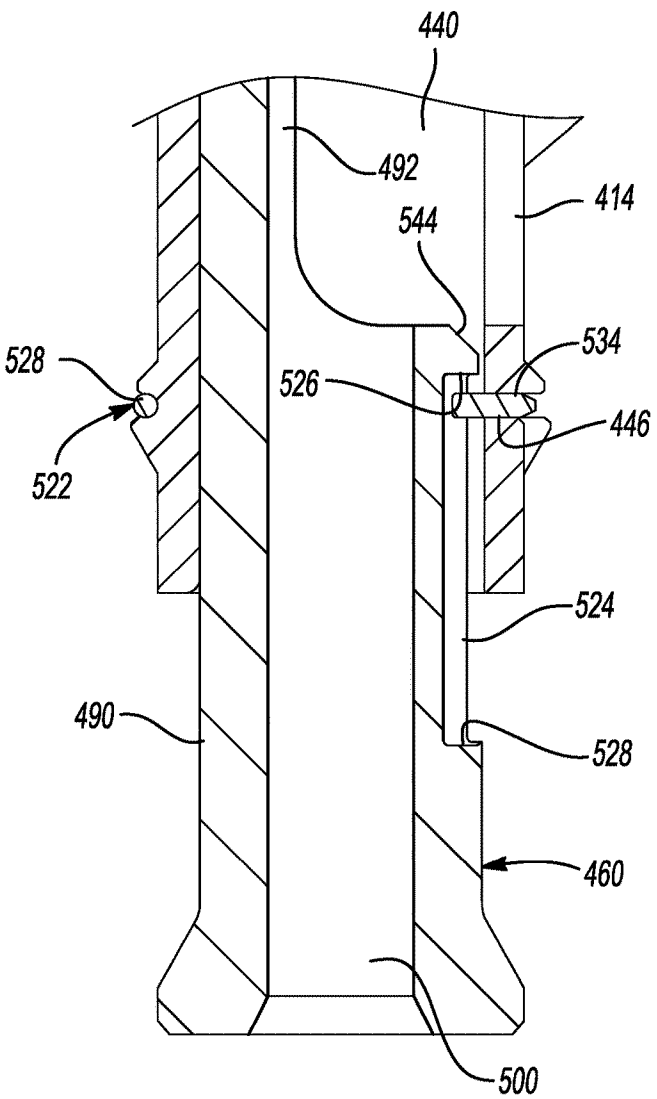
FIG. 19 is a longitudinal or axial section view of a portion of the components of the alternative contact trip latch embodiment of FIG. 17 illustrating the lower contact trip received in the barrel and a latch that is disengaged from the barrel.
Figure 18:
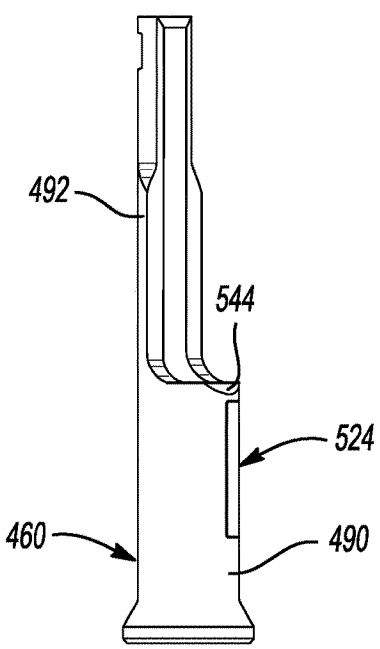
FIG. 18 is an exploded elevation view of the nosepiece assembly components or component portions of FIG. 17.
Figure 17:
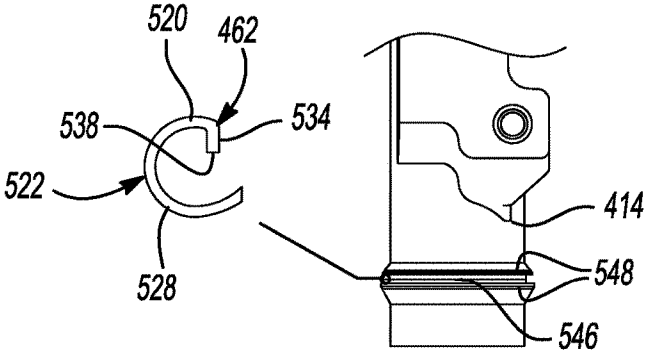
FIG. 17 is a side elevation view of a portion of various nosepiece assembly components including another example embodiment of a removable lower contact trip latch useful as an alternative to that detailed in FIGS. 10-14.
Figure 17:
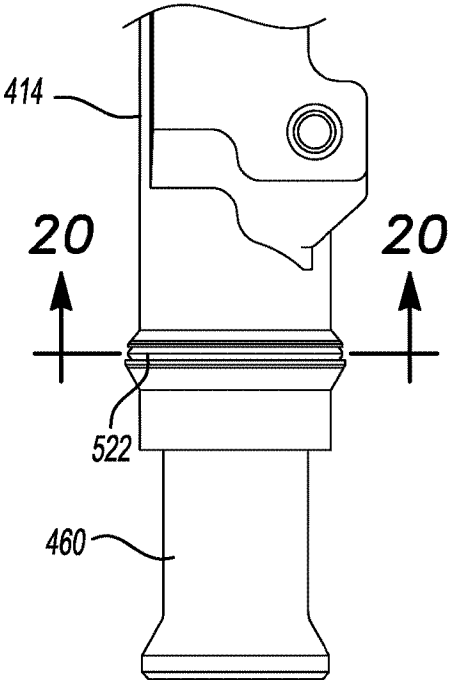
Figure 20:
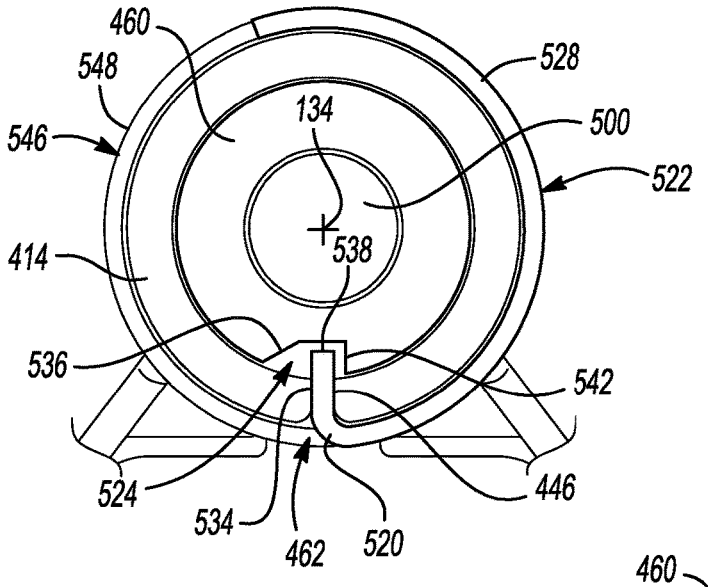
FIG. 20 is a transverse section view taken along line 20-20 of FIG. 17 and illustrating the removable lower contact trip received in the barrel and with the removable lower contact trip latch components of FIG. 17 engaged in a latched position to retain the lower contact trip within the barrel.
Figure 21:
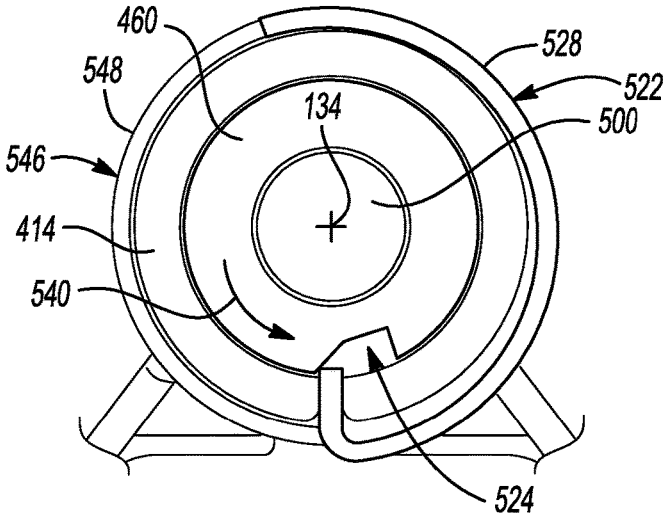
FIG. 21 is a transverse cross-section view similar to FIG. 20, but with the removable lower contact trip latch components of FIG. 17 in the process of being unlatched from the lower contact trip.
Figure 22:
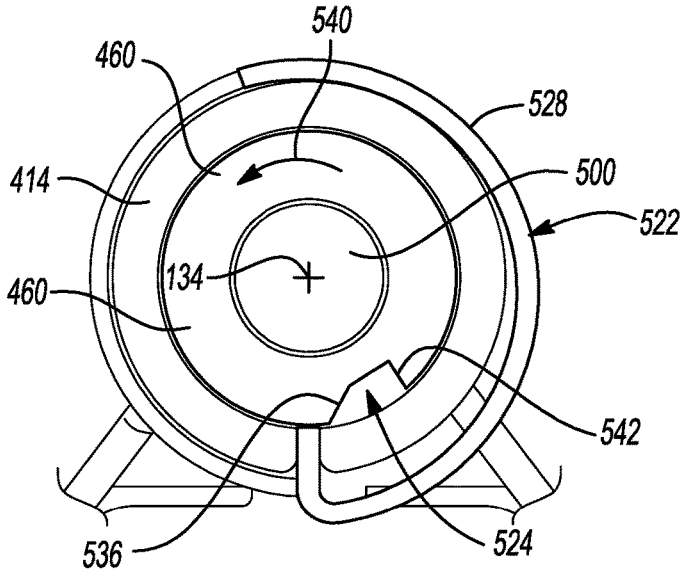
FIG. 22 is a transverse cross-section view similar to FIG. 20, but with the removable lower contact trip latch components of FIG. 17 disengaged or in an unlatched position permitting removal of the lower contact trip from the barrel.
Figure 23:
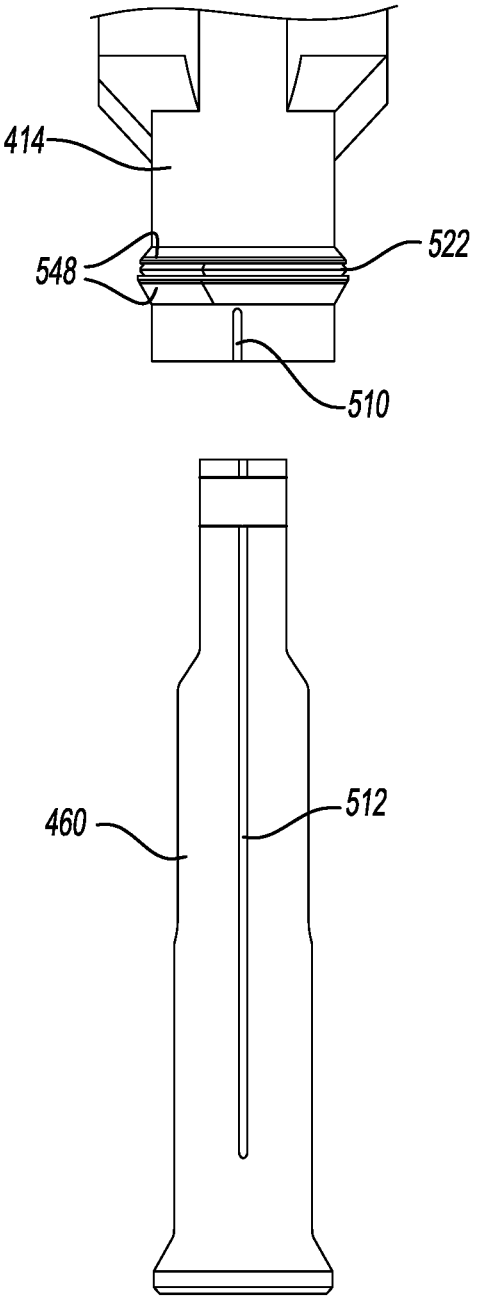
FIG. 23 is an exploded front elevation view similar to that of FIG. 18.
Figure 24:
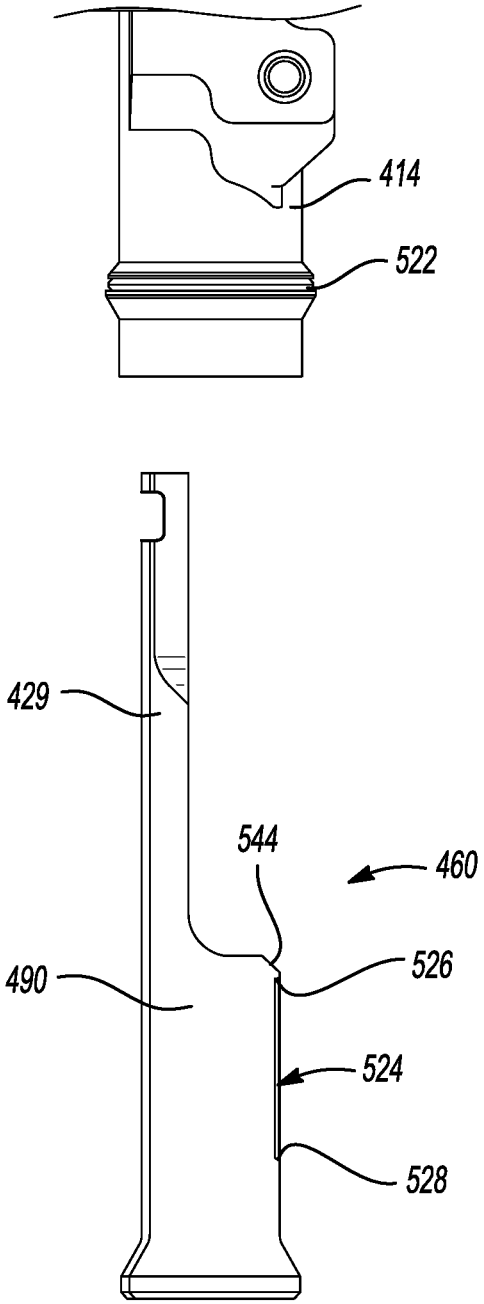
FIG. 24 is an exploded side elevation view similar to that of FIG. 18.

With reference to FIGS. 7 and 16, the removable lower contact trip 460 can be abutted against a workpiece to urge the removable lower contact trip 460 against the biasing force of the contact trip spring 556 along the driver axis 134 in a direction toward the PTU 66 into a retracted position relative to an end of the barrel 414. Since the contact trip lever 572 extends through the contact trip window 446 in the barrel 414 in-line with the muzzle projection 492, sufficient movement of the removable lower contact trip 460 in the direction toward the PTU 66 can cause corresponding movement of the yoke member 554 and plunger 552 against the bias of the contact trip spring 556. If the movement of the yoke member 554 in this manner is sufficiently large, and if the movement of the actuator 558 with the yoke member 554 is not hindered, the actuator arm 592 can move the switch arm 472 about its pivot point so that the second arm member 652 moves into a position that causes the contact trip switch 34 (FIG. 2) to operate in a second state that is different from the first state. In the example provided, the first state of the contact trip switch is an open, non-conducting state, whereas the second state of the contact trip switch is a closed, conducting state. Thus, the upper contact trip assembly 470 can include various actuators 558 and/or extending arm members (e.g., 574, 492, 650, and 652) to link movement of the removable contact trip 460 between the extended and retracted positions with movement of the contact trip switch 34 between a first switch state and a second switch state, respectively. As will be appreciated, operation of the contact trip switch 34 (FIG. 2) can be coordinated with the operation of other switches (e.g., the trigger switch 30 in FIG. 2) by the controller 38 (FIG. 2) to operate the PTU 66.

The spring shroud 404, which is optional, can be employed to shroud the barrel 414 in the area of the contact trip window 446 to prevent dirt and debris from entering the interior of the housing 12 through the contact trip window 446. The spring shroud 404 can include a shroud member 680 and a shroud arm 682 that can be fixedly coupled to the shroud member 680. The shroud member 680 can be fixedly coupled to the yoke member 554 and can be disposed about the contact trip spring 556. The shroud arm 682 can extend from the shroud member 680 and can be disposed alongside one of the arm members 130 of the activation arm 110. The shroud arm 682 can include a shroud arm surface 690 and a yoke axle recess 692. The shroud arm surface 690 is disposed in-line with the yoke axle 112. Contact between the yoke axle 112 and the shroud arm surface 690 inhibits movement of the yoke axle 112 in a direction toward the flywheel 62 by an amount that is sufficient to permit the pinch roller 96 to drive the driver 64 into engagement with the flywheel 62. However, alignment of the yoke axle 112 to the yoke axle recess 692 when the yoke member 554 has been moved toward the PTU 66 by a distance that is sufficient to permit the switch arm 472 to operate the contact trip switch 34, permits the pinch roller 96 to be moved in a direction toward the flywheel 62 by an amount that is sufficient to permit the pinch roller 96 to drive the driver 64 into driving engagement with the flywheel 62.

FIGS. 17 through 24 illustrate another example embodiment a removable lower contact trip latch useful as an alternative latch for the tool detailed in the prior figures. Corresponding elements of this embodiment use the same reference numbers as those used with respect to the prior example embodiment, regardless of whether the corresponding elements are identical or not. For brevity, aspects in common between the two removable contact trip latch embodiments and additional aspects of the tool will not necessarily be repeated below.

In this removable contact trip latch 462 example, the removable contact trip 460 is similarly received in an aperture 440 of the barrel 414 and is slidable between an extended position (similar to FIG. 5) and a retracted position (similar to FIG. 16) relative to an end of the barrel 414. The removable lower contact trip 460 can define a muzzle aperture 500 aligned with the driver axis 134 and through which a fastener is driven by the nail driver 64.

A single integrated and unitary spring clip 522 can include both a semi-circular shaped spring portion 528 that can provide biasing to the latch 462 and a bent end portion 534 that can provide the removable contact trip latch 462. The end portion 534 can be angled from the semi-circular shaped portion 528 to extend substantially along a radius of the semi-circular portion 528. In other words, the end portion 534 can extend substantially normal to an outer surface of the barrel 414.

The spring clip 522 can be mounted in an annular groove 546 around the barrel 414. The groove 546 can be defined by pair of annular projections 548. The spring clip 522 can bias the latch member 534 of the removable contact trip latch 462 toward a latched position in which the latch member extends through a window 446 of the barrel 414. In this specific example, this latch window 446 does not also serve as the window for the upper contact trip assembly 470.

The removable contact trip latch 462 can include a tubular muzzle 490 and a muzzle projection 492. The removable contact trip 460 can include a longitudinally elongated latch pocket 524 that can be located in an outer surface of the tubular muzzle 490. One elongated or longitudinal side 536 of the latch pocket 524 can define a latch removal surface 536. The latch removal surface 536 can be angled to engage against a distal end 538 of a latch member 534 of the removable contact trip latch 462 and to push the removable contact trip latch 534 from the latched position within the latch pocket 524 (FIG. 20) to the unlatched position outside the latch pocket 524 (FIG. 22) upon rotation of the removable contact trip 460 within the aperture 500 of the barrel 414, as indicated by arrow 540. Thus, rotation of the removable contact trip 460 within the barrel aperture 440 from a corresponding rotational latched position (FIG. 20) to a corresponding rotational unlatched position (FIG. 22) pushes the removable contact trip latch 462 out of the latch pocket 524. In this arrangement, the removable contact trip 460 can be removed by longitudinally or axially sliding it out of the barrel 414.

In addition to the previously-described rear axial end wall 528, and front axial end wall or removal stop surface 526 of the latch pocket 524, the opposite elongated or longitudinal side 536 of the latch pocket 524 can extend substantially along a radius of the removable lower contact trip 460. In other words, the opposite elongated or longitudinal side 536 of the latch pocket 524 can extend substantially normal to an outer surface of the removable contact trip 460.

The removable contact trip 460 can also have a latch insertion surface 544 positioned adjacent the latch pocket 524. The latch insertion surface 544 can be angled to engage against the distal end 538 of the removable contact trip latch 462 and to push the latch 462 from the latched position outside the latch pocket 524 to the unlatched position upon longitudinal or axial insertion of the removable contact trip 460 into the aperture 440 of the barrel 414. As previously described, each of the barrel 414 and the removable contact trip 460 can include cooperating alignment indicia 510, 512, respectively. Alignment of these cooperating alignment indicia 510, 512 facilitates proper rotational orientation of the removable contact trip 460 relative to the barrel 414 during insertion of the removable lower contact trip 460 into the barrel 414.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a different embodiment, even if not specifically shown or described. The same may also be varied in many ways. Such variations are not to be regarded as a departure from the disclosure, and all such modifications are intended to be included within the scope of the disclosure.

What is claimed is:

1. A cordless electric nailer comprising:

a battery-powered electric motor driven flywheel selectively engageable against a nail driver to fire the nail driver along a driver axis extending through an aperture of a barrel of a nosepiece;

a removable contact trip comprising a muzzle having a muzzle aperture received inside an interior of the aperture of the barrel with the driver axis coaxially extending through both the aperture of the barrel and the muzzle aperture inside the interior of the aperture of the barrel, and the muzzle being slidable between a retracted position and an extended position relative to an end of the barrel, a fastener being drivable through the muzzle aperture inside the interior of the aperture of the barrel and from the barrel by the nail driver, and the removable contact trip including latch pocket; and a removable contact trip latch coupled to the barrel and biased toward a latched position in which the removable contact trip latch extends through a window of the barrel and is receivable in the latch pocket inside the barrel to latch the removable contact trip to the barrel, and the removable contact trip latch being movable to an unlatched position in which the removable contact trip latch is not receivable in the latch pocket to unlatch the removable contact trip and permit removal of the contact trip from the barrel.

2. The cordless electric nailer of claim 1, wherein one side of the latch pocket comprises a latch removal surface, and wherein the latch removal surface is angled to engage against the removable contact trip latch and push the removable contact trip latch from the latched position within the latch pocket to the unlatched position outside the latch pocket upon rotation of the removable contact trip within the aperture of the barrel.

3. The cordless electric nailer of claim 2, wherein a side surface opposite the latch removal surface is substantially normal to an outer surface of the removable contact trip.

4. The cordless electric nailer of claim 1, wherein the removable contact trip has a latch insertion surface adjacent the latch pocket, and wherein the latch insertion surface is angled to engage against the removable contact trip latch and push the removable contact trip latch from the latched position outside the latch pocket to the unlatched position upon axial/longitudinal insertion of the removable contact trip into the aperture of the barrel.

5. The cordless electric nailer of claim 1, wherein the removable contact trip is biased toward the extended position and the latch pocket defines a removal stop surface along one end of the latch pocket, and the removal stop surface is biased against the removable contact trip latch when the removable contact trip is in the extended position.

6. The cordless electric nailer of claim 1, wherein the removable contact trip latch is an end portion of a spring clip that biases the removable contact trip latch toward a latched position.

7. The cordless electric nailer of claim 6, wherein the spring clip has a semi-circular shaped portion, and the removable contact trip latch is an end portion angled from the semi-circular shaped portion extending substantially along a radius of the semi-circular portion.

8. The cordless electric nailer of claim 6, wherein an outer surface of the barrel defines a groove and the spring clip is clipped into the groove.

9. The cordless electric nailer of claim 1, wherein the muzzle is tubular and has a muzzle projection.

10. The cordless electric nailer of claim 1, wherein rotation of the removable contact trip within the barrel aperture pushes the removable contact trip latch out of the latch pocket into the unlatched position.

11. The cordless electric nailer of claim 1, wherein rotation of the removable contact trip latch into the unlatched position pulls the removable contact trip latch out of the latch pocket.

12. The cordless electric nailer of claim 1, wherein the removable contact trip latch includes a lever grasping portion to facilitate rotation of the removable contact trip latch into the unlatched position.

13. The cordless electric nailer of claim 1, wherein each of the barrel and the removable contact trip include cooperating alignment indicia that, when aligned with each other, facilitate proper rotational orientation of the removable contact trip relative to the barrel during insertion of the removable contact trip into the barrel.

14. The cordless electric nailer of claim 1, further comprising an upper contact trip assembly including at least one extending arm member coupled to the barrel, wherein the upper contact trip assembly links movement of the removable contact trip between the extended and retracted positions with movement of the contact trip switch between a first switch state and a second switch state, respectively.

15. The cordless electric nailer of claim 14, wherein both the upper contact trip assembly and the removable contact trip latch extend through the window to engage the lower contact trip.

16. The cordless electric nailer of claim 1, wherein the cordless electric nailer is a concrete nailer.

17. The cordless electric nailer of claim 1, wherein:

the cordless electric nailer is a cordless electric concrete nailer, the nail driver is a concrete nail driver, and the fastener is a concrete fastener;

the removable contact trip latch is pivotably coupled to the barrel;

a biasing member biases the removable contact trip latch toward the latched position; and a lever extends from the removable contact trip latch and is manually engageable to pivot the removable contact trip latch against the biasing member and pull the removable contact trip latch from the latched position into the unlatched position.

18. The cordless electric nailer of claim 17, wherein the biasing member is a torsion spring.

19. The cordless electric nailer of claim 17, wherein the removable contact trip is biased toward the extended position and the latch pocket defines a removal stop surface along one end of the latch pocket, and the removable contact trip latch is biased against the removal stop surface when the removable contact trip is in the extended position.

20. The cordless electric nailer of claim 17, wherein the barrel includes muzzle guide rails engageable with a cooperating muzzle guide of the muzzle of the removable contact trip to prevent rotation of the removable contact trip relative to the barrel.

21. The cordless electric nailer of claim 20, wherein the muzzle is tubular and has a muzzle extension, and the cooperating muzzle guide comprises opposite sides of the muzzle extension.

22. The cordless electric nailer of claim 20, wherein tapered end surfaces are provided between the muzzle guide rails and the cooperating muzzle guide that facilitate proper rotational orientation of the removable contact trip during insertion of the removable contact trip into the barrel.

23. The cordless electric nailer of claim 17, wherein each of the barrel and the removable contact trip include cooperating alignment indicia that, when aligned with each other, facilitate proper rotational orientation of the removable contact trip during insertion of the removable contact trip into the barrel.

24. The cordless electric nailer of claim 17, further comprising an upper contact trip assembly including at least one extending arm member coupled to the barrel, wherein the upper contact trip assembly links movement of the removable contact trip between the extended and retracted positions with movement of the contact trip switch between a first switch state and a second switch state, respectively.

25. The cordless electric nailer of claim 17, wherein both the upper contact trip assembly and the removable contact trip latch extend through the window to engage the lower contact trip.

* * * * *